US005671554A

United States Patent [19]

Geelhoed

[11] Patent Number: 5,671,554

[45] Date of Patent: Sep. 30, 1997

[54] SENSOR POSITIONING APPARATUS FOR TRENCH EXCAVATOR

[75] Inventor: Jack Geelhoed, Boston, United Kingdom

[73] Assignee: J. Mastenbroek & Company Limited, Lincolnshire, England

[21] Appl. No.: 500,096

[22] Filed: Jul. 10, 1995

Related U.S. Application Data

[63] Continuation of PCT/GB94/02437, Nov. 7, 1994.

[30] Foreign Application Priority Data

Nov. 11, 1993 [GB] United Kingdom ..... 9323298

[51] Int. Cl.[6] ..... G05D 1/04

[52] U.S. Cl. ..... 37/348; 37/352; 172/4.5

[58] Field of Search ..... 37/348, 338, 413; 172/4.5; 364/167.01

[56] References Cited

U.S. PATENT DOCUMENTS

| | | | |
|---|---|---|---|
| 4,028,822 | 6/1977 | Teach . | |
| 4,034,490 | 7/1977 | Teach | 37/348 |
| 4,050,171 | 9/1977 | Teach | 37/348 |
| 4,200,787 | 4/1980 | Carson | 172/4.5 |
| 4,221,505 | 9/1980 | Taylor-Smith | 37/348 X |
| 4,244,123 | 1/1981 | Lazure et al. | 172/4.5 |
| 4,255,883 | 3/1981 | Ealy | 172/4.5 |
| 4,483,084 | 11/1984 | Caldwell et al. | 37/348 X |
| 4,537,259 | 8/1985 | Funabashi et al. | 172/4.5 |
| 4,741,646 | 5/1988 | Hatch | 37/348 X |
| 4,829,418 | 5/1989 | Neilsen et al. | 172/4.5 |
| 4,955,437 | 9/1990 | Bohman | 172/4.5 |
| 5,152,329 | 10/1992 | Browne et al. | 172/4.5 |
| 5,375,663 | 12/1994 | Teach | 172/4.5 |

FOREIGN PATENT DOCUMENTS 214416 3/1987 European Pat. Off. .

*Primary Examiner*—Terry Lee Melius
*Assistant Examiner*—Victor Batson
*Attorney, Agent, or Firm*—Cushman, Darby & Cushman IP Group of Pillsbury Madison & Sutro LLP

[57] ABSTRACT

Excavating apparatus includes a vehicle having excavating means in the form of a pivotal cutting boom pivotably mounted by way of mounting means on the vehicle. The cutting boom has an endless cutting clain drivingly mounted thereon and the boom is pivoted relative to the vehicle so as to vary the depth to which a trench is current. In seeking to cut a trench having a level floor irrespective of any undulations in the surface upon which the vehicle travels, a sensor is associated with the apparatus and is arranged to receive a reference signal. Any variation in the location at which the reference signal impinges on the sensor, for instance due to the passage of the vehicle up an incline, serves to determine the angle at which the cutting boom extends from the vehicle and so vary the depth to which the trench is cut. In order to achieve an accurate relationship between the movement of the position at which the signal impinges on the sensor, and the corresponding movement of the boom, the sensor is mounted by way of mounting means in such a way that it can move relative to the cutting boom along an arcuate path defined by arcuate guide means having a centre of curvature that corresponds to the axis of rotation of an idler about which the cutting clain travels.

30 Claims, 3 Drawing Sheets

SENSOR POSITIONING APPARATUS FOR TRENCH EXCAVATOR

This application is a continuation of international application No. PCT/GB94/02437 filed Nov. 7, 1994, which designated the U.S.

The present invention relates to improvements in and relating to excavating apparatus. In particular, the excavating apparatus comprises a vehicle having excavating means extending therefrom and being pivotable relative thereto so as to vary the depth of excavation.

Pivoting-boom type excavating apparatus is known for forming trenches or the like. Such apparatus is also known to incorporate a depth control system whereby the depth of the trench is controlled having regard to a reference signal such as a laser beam. It is intended that the annular position of the cutting boom relative to the vehicle, and thus the depth to which the trench is cut, is controlled having regard to the position at which the reference signal impinges on a sensor unit. The sensor unit is mounted on the cutting boom so as to move therewith as the cutting boom pivots. Thus, as the vehicle travels over undulating terrain, the sensor moves relative to the laser beam and this alters the position at which the laser impinges on the sensor. This produces a change in the output of the sensor which change is employed to control the pivotal motion of the cutting arm and so vary the depth of the trench during the vehicle's movement over the undulating terrain. This arrangement seeks to cut a trench having a floor that extends along a plane which is parallel to the reference beam.

However, such known apparatus is disadvantageous in that the accuracy in the depth of the trench that is cut is disadvantageously limited particularly when the vehicle travels over terrain having varied relief and thus when the cutting boom is required to pivot. In such instances, the trench is formed with a base which is not parallel to the reference signal. This can prove particularly problematic if the floor of the trench is required to extend in a level manner, i.e. when no, or only very minor, variations or undulations in the floor of the trench can be tolerated. This requirement particularly rises when a pipe, or any other structure that is to be laid within the trench, must be laid on an even and flat surface. A problem with known apparatus arises due to inaccuracy between the pivoting of the cutting boom, as controlled by the variation in the position at which the reference signal impinges on the sensor mounted for movement with the cutting boom. Primarily, the change in the angular position of the cutting boom relative to the vehicle does not accurately reflect the change in the position at which the reference laser beam impinges on the sensor unit. That is, a change in the position at which the laser impinges on the sensor, due to an upslope or downslope movement of the vehicle, does not result in an equal change in the depth to which the cutting boom extends beneath the vehicle.

The present invention seeks to provide excavating apparatus having advantages over known apparatus. In particular, the present invention seeks to provide excavating apparatus for operation in association with a reference signal at a greater degree of accuracy than is currently known.

According to one aspect of the present invention there is provided excavating apparatus comprising a prime mover having excavating means for excavating a trench with a floor which is to be substantially parallel to a reference signal, said apparatus having sensor means for detecting said reference signal and said excavating means being pivotable relative to said prime mover to vary the depth of said trench, said sensor means being moveable relative to said prime mover such that, as said excavating means pivots, said sensor means moves along a path which is substantially the same in direction and distance as the path of movement of the lowest surface of said excavating means.

The invention is thus advantageous in that any change in position of the lowest excavating surface, ie. the cutting surface of the excavating means that cuts the floor of the trench, relative to the vehicle, effects a corresponding change in the position of the sensor means.

The prime mover may comprise any appropriate form of vehicle.

According to another aspect of the present invention there is provided sensor positioning apparatus for excavating apparatus comprising a prime mover having pivotable excavating means and reference-signal sensor means, said sensor positioning means being arranged to move said sensor means along a path that is substantially the same in direction and distance as the path of movement of the lowest surface of said excavating means when said excavating means pivots.

Preferably, said sensor means is arranged to move relative to said vehicle along an arcuate path having a centre of curvature in the region of said lowest surface of the excavating means. Controlling the movement of said sensor in this manner is particularly advantageous in that the separation between the sensor and the lowest surface of said excavating means remains at a substantially constant value during the pivotal motion of said excavating means. Thus, irrespective of the angular position of the pivotal excavating means relative to the vehicle, the separation between the lowest surface of the excavating means and the sensor, and thus the reference signal, remains substantially constant. Accordingly, as the vehicle travels over undulations, the excavating means pivots so as to compensate for the undulations in the surface and thus retain the floor of the trench being excavated substantially parallel to the reference signal.

Most conveniently, the excavating means includes a plurality of cutting tools which, at the lowest region of the excavating means, travel in a substantially circular, or at least semi-circular, path. The centre of curvature of said arcuate path along which the sensor means is arranged to move can then advantageously corresponds to the centre of curvature of said circular or said at least semi-circular path of said cutting tools.

In particular, said circular or at least semi-circular path of said cutting tools can be defined by a rotatable member. The centre of curvature of said arcuate path of the sensor is arranged to correspond with the axis of rotation of said rotatable member.

In some instances, the rotatable member may comprise a circular cutting member. Alternatively, the rotatable member may comprise an idler wheel which is arranged to rotate and carry a cutting chain.

When the cutting tools are arranged to travel around said circular, or at least semi-circular path, the lowest surface of the excavating means, ie. the lowest of the cutting tools, remains the same distance from the centre of curvature of that circular or semi-circular path irrespective of the angle of the excavating means relative to the vehicle. Thus, since the arcuate path of the sensor has its centre of curvature at the centre of curvature of the path of the cutting tools, ie. the axis of rotation of the rotary member, this arrangement proves particularly effective in maintaining the required separation between the sensor and the lowest surface of the excavating means.

Preferably, the sensor means can be moved along the required path by drive means, for example electric, hydraulic or pneumatic drive means.

In a particularly advantageous and simple embodiment of the invention, the sensor means is mounted upon said excavating means. In particular, said sensor is mounted on said excavating means by way of a support member which can comprise a mast for retaining the sensor means at a position above the highest part of the vehicle.

Preferably, the sensor support means is mounted on the excavating means for movement along a track which extend from said excavating means. As such, the track can advantageously extend in an arcuate manner which corresponds to the arc along which the sensor means is required to move.

The provision of such an arcuate track member is particularly advantageous in providing a simple and effective means for moving said sensor member along the required path. Accordingly, the track extends along an arcuate path which has its centre of curvature at the required position at the lower region of said excavating means.

Accordingly, the invention can provide an arcuate track and sensor support means which is arranged to be mounted for movement along said track.

Preferably, control means are provided for controlling the movement of said sensor along said path, the control means being associated with means for detecting a change in the position of the vehicle relative to the reference signal.

As such, the control means may include a level detector for detecting when said vehicle travels up or down over undulations in the terrain.

Indeed, if it proves advantageous to retain the sensor means, and in particular the mast associated therewith, substantially perpendicular to the reference signal, such level sensor means can be provided for retaining the sensor in such a perpendicular relationship with the reference signal.

In a particularly advantageous embodiment of the invention, when said level sensor means detects that, due to the vehicle moving uphill or downhill and/or pivotal motion of said excavating means, the sensor means is no longer positioned perpendicular to the reference beam, drive means can be activated so as to move the sensor along said arcuate path. Further advantageous and particularly simplified operation can be achieved if the sensor mounting means, for example the mast, extends in the direction of the radius of curvature of the arcuate path of travel of the sensor. Thus, irrespective of the position of the sensor means along its possible arcuate path, the sensor mounting means extends in a radial direction such that movement of the sensor along its radial path to return the sensor to a position which is substantially perpendicular to the reference beam serves to retain the sensor at the required separation from the lowest surface of the excavating means.

In this manner, when the vehicle travels upwards or downwards relative to the reference signal, the sensor means determines that the excavating means should pivot and the level sensor determines that the sensor means should travel along its arcuate path. When, due to a combination of this movement, the reference signal, e.g. a laser beam, infra-red beam or radio signal, next impinges on the required part of the sensor means, it can be established that the trench is then being cut to the correct depth having regard to the reference signal.

The present invention is particularly advantageous in that not only can the angle of the sensor face relative to the reference beam be accurately controlled, but the sensor's position relative to the boom can be varied and controlled so that the change in position at which the beam impinges on the sensor is accurately reflected in an appropriate movement of the cutting boom.

Also, by simply providing an arcuate track along which a sensor-carrying mast is arranged to move when a level sensor associated with the mast detects that the mast has become inclined to its required direction of extension, the accuracy at which the depth of a trench is formed can be greatly improved having regard to the accuracy currently achievable.

The invention is described further hereinafter, by way of example only, with reference to the accompanying drawings in which.

Figure 1:
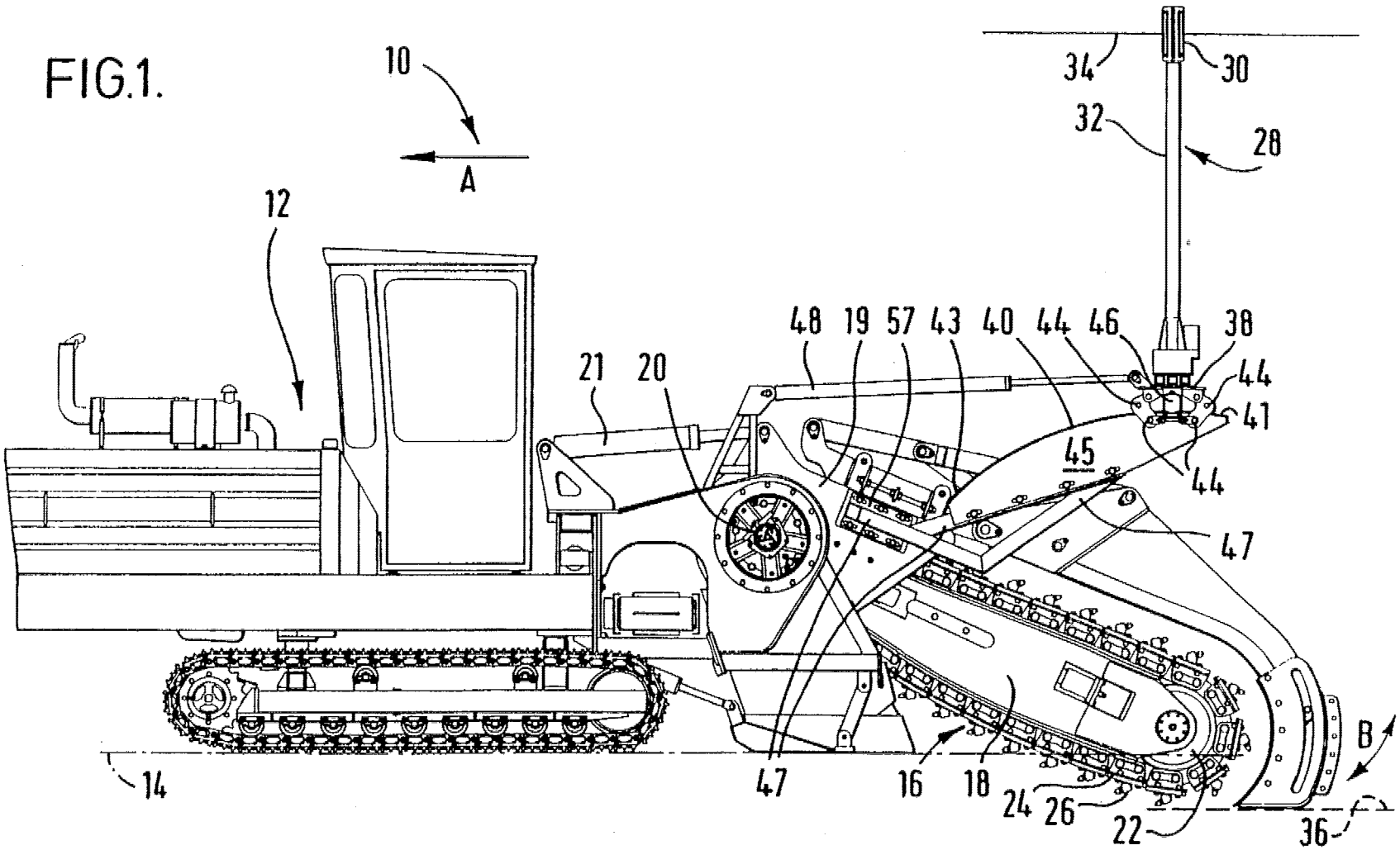
FIG. 1 is a side elevational view of excavating apparatus embodying the present invention and showing excavating means in a position for cutting a shallow trench.

With reference to FIG. 1, there is shown excavating apparatus 10 embodying the present invention. The apparatus 10 comprises a prime mover in the form of a vehicle 12 for moving in the direction of arrow A over a surface 14 in which a trench is to be cut. The apparatus 10 also includes excavating means which comprises a pivotable cutting boom 16. The cutting boom 16 comprises a support arm 18 which is mounted in a cutting boom support housing 19 and which is pivotably mounted on the tracked vehicle 12 by mounting means 20 for movement in the direction of arrow B. Drive means 21 is provided for pivoting the cutting boom 16 about the mounting 20. The support arm 18, at its end remote from the tracked vehicle 12, carries an idler wheel 22 and an endless cutting chain 24 is arranged to pass around the idler wheel 22. The endless cutting chain 24 comprises a plurality of cutting tools for example cutting teeth 26. The endless cutting chain 24 also passes around a drive wheel (not shown) which is mounted at the end of the cutting boom 16 adjacent the mounting 20.

The apparatus 10 also includes cutting-depth-control sensor means 28 comprising a sensor 30 mounted at the top of a mast 32. The sensor 30 is arranged to receive a reference signal comprising a laser beam 34 which is emitted from a laser source (not shown in FIGS. 1 and 2). The laser beam 34 comprises a reference signal which serves as a reference for controlling the depth at which a trench is cut by the endless cutting chain 22 of the cutting boom 16. As illustrated in FIG. 1, the apparatus 10 is arranged to cut a trench in the surface 14 upon which the tracked vehicle 12 moves. The trench then cut has a floor 36. The depth-control-sensor means 28 serves to maintain the separation between the reference laser beam 34 and the floor 36 of the trench at a substantially constant value. Thus, a trench can be cut having a floor which extends along a plane parallel to the reference laser beam 34. Since the reference laser beam 34 has an inherently high directional accuracy, a trench having correspondingly accurate directional characteristics can be readily cut by means of the apparatus 10.

Thus, the floor 36 can be formed at the required depth below the reference beam with a high degree of accuracy.

The mast 32 is mounted in a mast-carriage unit 38. The mast-carriage unit 38 is mounted on an arcuate track 40 for movement between the two extreme ends 41, 43 of the track 40. The track 40 comprises a flange formed at an arcuate edge of an extension plate 45. The extension plate 45 is rigidly mounted onto the cutting boom 16 by way of support arms 47. The support arms 47 are secured to the cutting boom support housing 19 by way of a connection plate 57.

The connection plate 57 allows for the position of the support arms 47, and thus the track 40, to be adjusted in view of any extension of the cutting boom 16 that is needed for example to compensate for wear of the cutting chain 24. The correct distance 50 (see FIG. 2) is then maintained. The mast-carriage unit 38 is movably mounted on the track 40 by means of four guide wheels (not shown) rotatably connected to the mast-carriage unit 38 by way of four respective axles 44.

Figure 2:
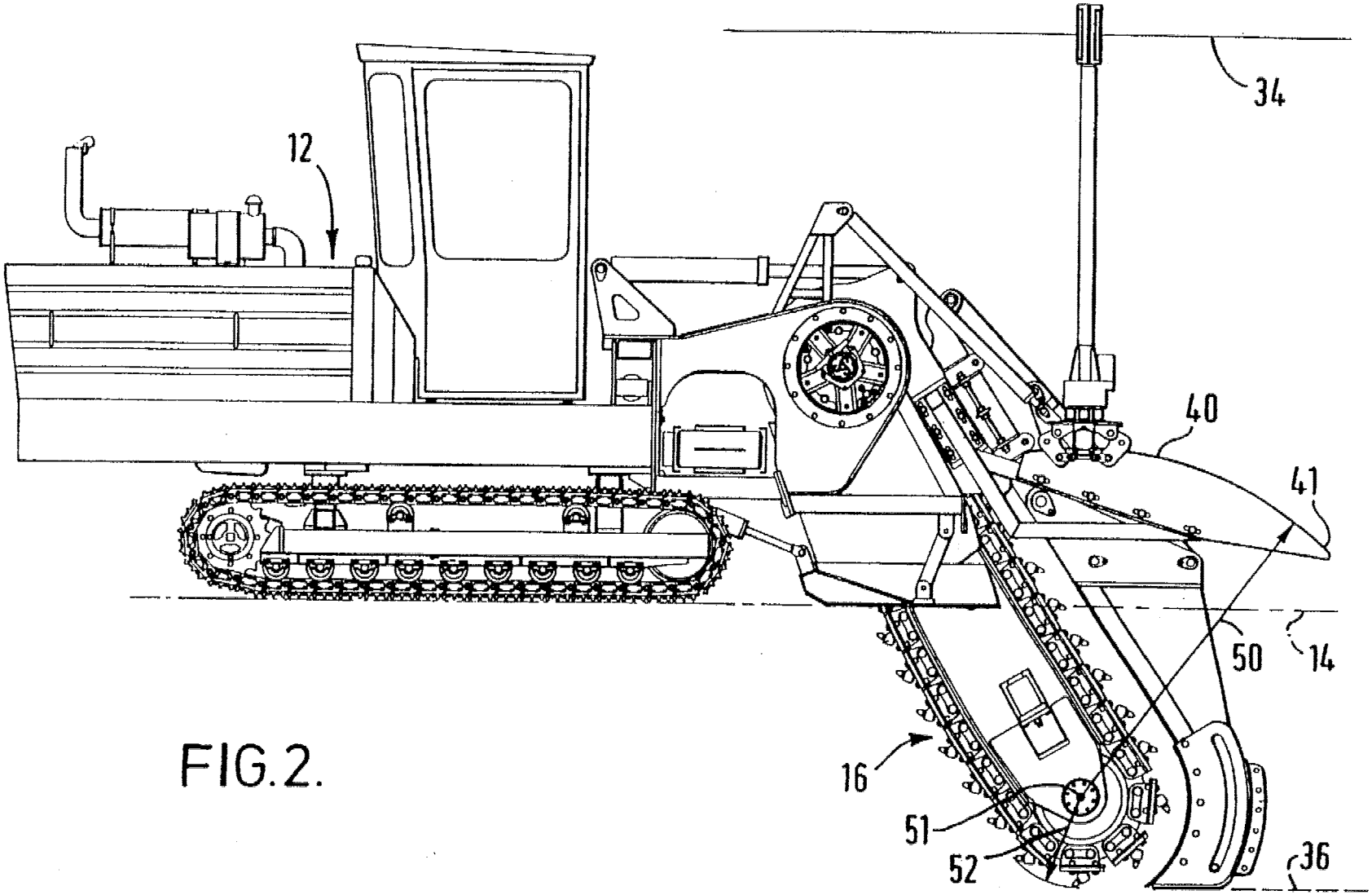
FIG. 2 is a side elevational view of the apparatus of FIG. 1 but with the excavating means in a position for cutting a deeper trench than that cut according to FIG. 1.

Further, the mast-carriage unit 38 includes a level sensor 46 which is effective to determine when the mast 32 becomes tilted out of its substantially vertical position shown in FIG. 1, and thus also out of a substantially perpendicular relationship with the reference laser beam 34 shown in FIGS. 1 and 2.

A hydraulic drive arm 48 is included so as to move the mast 32 and senor 30, by moving the mast-carriage unit 38 along the arcuate path defined by the track 40.

With reference to FIG. 2, the apparatus of FIG. 1 is shown with the cutting boom 16 in an angular position relative to the tracked vehicle 12 so as to cut a trench which is at a maximum possible depth having regard to the surface 14 upon which the vehicle 12 travels. Although the substantially perpendicular relationship between the mast 32 and the reference laser beam 34 has been retained, it will be appreciated from comparison between FIGS. 1 and 2 that the mast-carriage unit 38 has moved along the full length of the track 40, i.e. from one end 41 (FIG. 1) to the other end 43 (FIG. 2).

As described below, the movement of the mast-carriage unit 38 along the arcuate track 40 serves to maintain an accurate separation between the sensor 30 and the lowermost cutting surface of the cutting boom 16. This in turn serves to maintain the floor 36 of the trench being cut at the required distance from the reference laser beam 34.

The mast 32 is rigidly mounted in the mast-carriage unit 38 so that no relative movement occurs between the mast 32 and unit 38. Also, the arcuate path defined by the arcuate track 40 has a centre of curvature which is located at the axis of rotation 51 of the idler wheel 22. Thus, as will be appreciated from the drawings, at whatever position along the track 40 the mast-carriage unit 38 is located, the mast 32 will always extend in a radial direction from the centre of curvature of the track 40, i.e. the axis of rotation 51 of the idler wheel 22. Thus, the separation between the axis of rotation 51 of the idler wheel 22 and the sensor 30 will remain constant and comprise the sum of the radius of curvature 50 of the track 40 and the height of the mast 32 and sensor 30. Since the endless cutting chain 24 travels around a semi-circular path centered on the axis of rotation 51 of the idler wheel 22, the distance 52 between the axis of rotation 51 of the idler wheel 22 and the lowermost cutting surface of the cutting boom 16, i.e. that part of the cutting boom 16 that cuts the deepest part of the trench, remains constant whatever the angular relationship between the cutting boom 16 and the vehicle 12. Thus, in controlling the movement of the mast-carriage unit 38 along the track 40, as the cutting boom 16 is pivoted between the two extreme positions shown in FIGS. 1 and 2, the separation between the sensor 30 and the lowermost cutting surface of the cutting boom 16 can remain substantially constant. Accordingly, by retaining the sensor 30 in a position relative to the reference laser beam 34 such that the laser beam 34 impinges on a nationally correct part of the sensor 30, a trench can be cut having a base 36 that extends along a plane which is substantially parallel to the reference laser beam 34. The highly directional characteristic of the reference beam 34 is thus reflected in an accurately level and even trench floor 36.

Also, in centering the centre of curvature of the track on the axis of rotation of the idler wheel 22, the apparatus can be readily used with a cutting boom having an idler wheel of any required radius, and requiring only minor adjustment.

In accordance with the illustrated embodiment, the level sensor 46 located in the mast-carriage unit 38 is employed to determine when, and how far, the mast-carriage unit 38 should be moved along the track 40 so as to retain the correct spacing between the sensor 30 and lowermost cutting surface of the cutting boom 16 during the pivoting of the boom 16. For example, when considering the movement of the cutting boom 16 from the position shown in FIG. 1 to the position shown in FIG. 2, it will be appreciated that such pivotal motion causes the mast 32 to tilt to the right as shown in FIG. 1. The level sensor 46 detects this tilting and the associated movement away from the vertical position of the mast 32 as shown in FIG. 1. The level sensor 46 which may comprise a mercury switch controls the operation of the hydraulic drive arm 48 so as to move the mast-carriage unit 38 in a direction to the left in FIG. 1. This movement along the arcuate track 40 not only decreases the height of the sensor 30 relative to the vehicle 12, but also serves to return the sensor 30 to its substantially perpendicular relationship with the reference laser beam 34. The required separation between the lowermost cutting surface of the cutting boom 16 and the sensor 30 is thereby maintained. Of course, the level sensor 46 also serves to determine when the mast 32 has returned to the correct position in which it is substantially perpendicular to the reference laser beam, as in FIGS. 1 and 2.

The invention proves particularly advantageous when the terrain along which the vehicle 12 has to travel is of varied relief. In such a situation, the trench may still have to be cut so that its floor 36 remains substantially parallel to the reference laser beam 34. In such a situation, the depth at which the trench is cut varies with the variation in the terrain.

Figure 3:
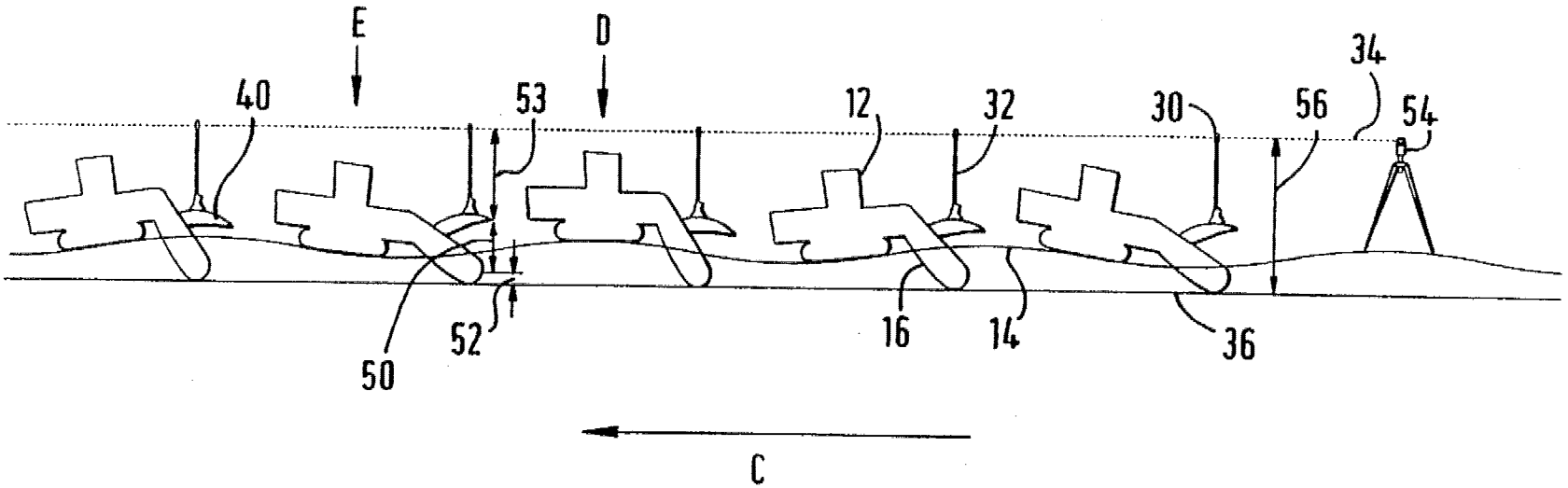
FIG. 3 is a schematic side elevational view illustrating the operation of the apparatus of FIGS. 1 and 2 as it travels over terrain having varied relief.

FIG. 3 is a schematic diagram showing five positions of the excavating apparatus 10 of FIGS. 1 and 2 as it travels in the direction of arrow C over the ground surface 14 having varied relief as shown. A laser source 54 is set up so as to provide a laser reference beam 34 which extends in a substantially horizontal direction. Of course, the reference signal could be directed in an inclined manner so that the trench floor has a corresponding inclination. The laser beam 34 is arranged to serve as a reference so that a trench is cut having a floor 36 which is substantially parallel to the reference beam 34 even though the relief of the surface upon which the vehicle 12 travels varies. Thus, as the vehicle 12 travels over the surface 14, the angular position of the cutting boom 16 relative to the vehicle 12 varies so as to vary the depth of the trench being cut. Likewise, as the angular relationship between the cutting boom 16 and the vehicle 12 varies, the mast 32 is moved along the arcuate track 40 such that the mast 32 is retained in the substantially vertical position of FIGS. 1 and 2 and thus substantially perpendicular relative to the reference laser beam 34.

Prior to operation, the apparatus is adjusted such that the separation between the sensor 30 and the lowest cutting surface of the cutting chain 24, i.e. the lowest of the cutting teeth 26, corresponds to the required separation between the trench floor 36 and the reference laser beam 34. The cutting chain 24 is then driven and the cutting boom pivoted as the cutting chain 24 cuts to the required depth, i.e. until the sensor 30 receives the reference laser beam 34. The sensor 30 is then calibrated such that it is established that the position at which the laser beam 34 impinges on the sensor is the correct position having regard to the required level of the trench floor 36. Any variation from this position is effective to cause the cutting boom 16 to pivot and so compensate for variations in the terrain as described further herein.

The level sensor 46 provided in the mast-carriage unit 38 serves to control the movement of the mast-carriage unit 38 as described above with reference to FIGS. 1 and 2. Thus, the mast-carriage unit 38 moves along the track 40 in a manner so as to retain the required separation between the sensor 30 and the lowermost cutting surface of the cutting boom 16.

Operation of the invention is particularly illustrated with reference to the movement of the vehicle 12 between the positions D and E in FIG. 3. As the vehicle 12 moves from position D, it moves downhill and so the reference laser beam 34 begins to impinge on a higher part of the sensor 30 than it did previously. This change in the location at which the laser impinges on the sensor 30 is detected by the sensor 30 and, in response control apparatus (not shown) determines that the vehicle is travelling downhill. Thus, in order to maintain the required level of the floor 36 of the trench being cut, the control apparatus causes the cutting boom 16 to pivot in an anti-clockwise direction. This lifts the lowermost cutting surface of the cutting boom 16 relative to the vehicle. The pivotal motion of the cutting boom 16 is arranged to continue until the vertical position of the sensor 30 is located such that the reference laser beam 34 again impinges on the correct part of the sensor 30. This then indicates that the trench is being cut with a floor 36 separated by the required distance from the reference signal 34. In order to maintain this required separation, it is important that the separation between the sensor 30 and the lowermost cutting surface of the cutting boom 16 remains substantially constant irrespective of the angular position of the cutting boom 16 relative to the vehicle 12. Thus, as the vehicle 12 begins to travel downhill from position D to position E, the level sensor 46 located in the mast-carriage unit 38 initiates the operation of the hydraulic drive arm 48 so as to move the mast-carriage unit 38 along the track 40 until the level sensor 46 indicates that the mast 32 is again in the required position. This required position being one in which the mast 32 is substantially perpendicular to the reference laser beam 34, and the sensor then correctly separated from the trench floor 36.

As will be appreciated, the movement of the mast-carriage unit 38 along the track 40, and thus the movement of the mast 32 and sensor 30, is determined by the distance that the cutting boom 16 is actually pivoted relative to the vehicle 12 in order to maintain the sensor 30 in the required position relative to the laser reference beam 34. As will be particularly understood from FIG. 3, this movement serves to accurately maintain the required separation between the sensor 30 and the floor 36 of the trench being cut. As shown in FIG. 3, this distance comprises the height of the mast 53, the radius of the curvature 50 of the arcuate track 40 and the radius of curvature 52 of the semi-circular path travelled by the endless cutting chain 24 about the idler wheel 22. Also, since the mast-carriage unit 38 travels around the arcuate track 40, this distance remains the same irrespective of the height above the base of the trench that the vehicle actually travels. Of course, the track 40 can be provided in any appropriate form such as a member with an arcuate track surface as illustrated in the drawing, or with an arcuate slot formed therein.

Whilst the invention has been illustrated with reference to the specific embodiments described above, many modifications and variations thereof are possible within the scope of the invention.

As one skilled in the art will appreciate, the movement of the mast 32 and sensor 30 can be achieved by directional control means other than the arcuate track 40 illustrated. The particular requirement is that, during the pivotal motion of the cutting boom 16, the sensor 30 is moved in the same direction, and for the same distance, as the lowermost cutting surface of the cutting boom 16. Also, any suitable cutting means may be employed on the cutting boom 16 and the reference signal may comprise an infra-red beam or radio signal.

Further, in order to allow for any variations in relief in a direction perpendicular to the longitudinal direction of the trench, the vehicle can be provided with side-tilt compensation means as currently available. Additionally, the excavating apparatus can be provided with an installation box, commonly connected behind the cutting boom in the direction of travel, for the insertion of material, e.g. gravel, or the installation of apparatus, e.g. pipe lengths or cable, into the trench.

I claim:

1. Excavating apparatus comprising:

a prime mover having excavating means for excavating a trench with a floor which is to be substantially parallel to a reference signal, said apparatus having sensor means for detecting said reference signal and said excavating means being pivotable relative to said prime mover to vary the depth of said trench, said sensor means being moveable relative to said excavating means such that, as said excavating means pivots, said sensor means moves relative to said prime mover along a path which is substantially the same in direction and distance as the path of movement relative to said prime mover of the lowest surface of said excavating means, said sensor means being movable relative to said excavating means along an arcuate path having a centre of curvature in the region of the end of said excavating means remote from the prime mover, and arcuate guide means for defining said arcuate path of movement of said sensor means relative to said excavating means, said sensor being mounted for movement upon said arcuate guide means.

2. Apparatus as claimed in claim 1, wherein the centre of curvature of said arcuate guide means is in the region of the end of the excavating means remote from the prime mover.

3. Apparatus as claimed in claim 1 wherein said arcuate guide means extends from said excavating means.

4. Apparatus as claimed in claim 3, wherein said arcuate guide means comprises a member having an arcuate guide surface provided thereon.

5. Apparatus as claimed in claim 3, wherein said arcuate guide means comprises a member having an arcuate slot defined therein.

6. Apparatus as claimed in claim 3, wherein said arcuate guide means comprises an arcuate member.

7. Apparatus as claimed in claim 1, wherein said excavating means includes a plurality of cutting tools which, in the region of the excavating means remote from the prime mover, travel in an at least semicircular path.

8. Apparatus as claimed in claim 7, wherein said centre of curvature corresponds to the centre of curvature of said at least semi-circular path.

9. Apparatus as claimed in claim 8, wherein said at least semi-circular path of said cutting tools is defined by a rotatable member.

10. Apparatus as claimed in claim 9, wherein said centre of curvature is arranged to correspond to the axis of rotation of said rotatable member.

11. Apparatus as claimed in claim 1, wherein said sensor means is arranged to move along the required path by drive means.

12. Apparatus as claimed in claim 1, further comprising control means for controlling the movement of said sensor along said path, said control means being associated with means for detecting a change in the position of said vehicle relative to said reference signal.

13. Apparatus as claimed in claim 12, wherein said means for detecting the change in the position of said vehicle relative to said reference signal comprises level sensor means.

14. Apparatus as claimed in claim 13, wherein said level sensor means is mounted for movement with said sensor.

15. Sensor positioning apparatus for use with excavating apparatus of the type including a prime mover having pivotable excavating means and having reference-signal sensor means, comprising:

means to move said sensor means relative to the prime mover along a path that is substantially the same in direction and distance as the path of movement relative to the prime mover of the lowest surface of said excavating means when said excavating means pivots, said sensor means being movable, by said means to move, relative to said excavating means along an arcuate path having a centre of curvature in the region of the end of said excavating means remote from the prime mover, and arcuate guide means for defining said arcuate path of movement of said sensor means relative to said excavating means, said sensor means being mounted for movement upon said arcuate guide means.

16. Excavating apparatus comprising:

a prime mover having excavating means for excavating a trench with a floor which is to be substantially parallel to a reference signal, said excavating means having a plurality of cutting tools which at the lowest region of the excavating means travel in a path passing around a rotatable member at the end of said excavating means remote from the prime mover, and said excavating means being pivotable relative to said prime mover to vary the depth of said trench;

sensor means for detecting said reference signal;

sensor positioning means for moving said sensor means relative to said excavating means as said excavating means pivots;

said sensor means being moveable, by said sensor positioning means, relative to said excavating means along an arcuate path having a centre of curvature in the region of the axis of rotation of said rotatable member of said excavating means such that, as said excavating means pivots, said sensor means moves relative to said prime mover along a path which is substantially the same in direction and distance as the path of movement relative to said prime mover of the lowest surface of said excavating means, and arcuate guide means for defining said arcuate path of movement of said sensor means relative to said excavating means, said sensor means being mounted for movement upon said arcuate guide means.

17. Apparatus as claimed in claim 1 or 16, and including detector means for detecting if said sensor means moves out of a required angular position relative to the reference signal, and drive means for moving said sensor means along said path in response to a change in output of said detector means.

18. Sensor positioning apparatus for use with excavating apparatus of the type including a prime mover having pivotable excavating means having a plurality of cutting tools which at the lowest region of the excavating means travel in a path passing around a rotatable member at the end of said excavating means remote from the prime mover, and having reference-signal sensor means;

said sensor positioning apparatus comprising sensor positioning means for moving said sensor means relative to said excavating means as the excavating means pivots;

said sensor means being moveable by said sensor positioning means, relative to said excavating means along an arcuate path having a centre of curvature in the region of the axis of rotation of said rotatable member of said excavating means so as to move said sensor means relative to said prime mover along a path that is substantially the same in direction and distance as the path of movement relative to the prime mover of the lowest surface of said excavating means when said excavating means pivots, and arcuate guide means for defining said arcuate path of movement of said sensor means relative to said excavating means, said sensor means being mounted for movement upon said arcuate guide means.

19. Apparatus as claimed in claim 16 or 18, wherein the sensor means is mounted on a mast, the base of the mast being moveable relative to the excavating means as the excavating means pivots, and the angle of the mast relative to the reference signal being arranged to be constant during such movement.

20. Apparatus as claimed in claim 16 or 18, wherein the centre of curvature of said arcuate guide means is in the region of the axis of rotation of said rotatable member of the excavating means.

21. Apparatus as claimed in claim 20, wherein said arcuate guide means extends from said excavating means.

22. Apparatus as claimed in claim 21, wherein said arcuate guide means comprises a member having an arcuate guide surface provided thereon.

23. Apparatus as claimed in claim 22, wherein said arcuate guide means comprises a member having an arcuate slot defined therein.

24. Apparatus as claimed in claim 20, wherein said arcuate guide means comprises an arcuate member.

25. Apparatus as claimed in claim 16 or 18, wherein said plurality of cutting tools, in the region of the excavating means remote from the prime mover, travel in an at least a semi-circular path.

26. Apparatus as claimed in claim 16 or 18, wherein said centre of curvature is centered on the axis of rotation of said rotatable member.

27. Apparatus as claimed in claim 16 or 18, wherein said sensor means is arranged to move along the required path by drive means.

28. Apparatus as claimed in claim 16 or 18, further comprising control means for controlling the movement of said sensor means along said path, said control means being associated with means for detecting a change in the position of said vehicle relative to said reference signal.

29. Apparatus as claimed in claim 28, wherein said means for detecting the change in the position of said vehicle relative to said reference signal comprises level sensor means.

30. Apparatus as claimed in claim 29, wherein said level sensor means is mounted for movement with said sensor means.

* * * * *